United States Patent [19]

Seiki

[11] Patent Number: 4,519,927

[45] Date of Patent: May 28, 1985

[54] LUBRICANT FOR USE AT HIGH TEMPERATURE

[75] Inventor: Hiromichi Seiki, Ichihara, Japan

[73] Assignee: Idemitsu Kosan Company Limited, Tokyo, Japan

[21] Appl. No.: 566,497

[22] Filed: Dec. 29, 1983

[30] Foreign Application Priority Data

Jan. 17, 1983 [JP] Japan ..... 58-4225

[51] Int. Cl.[3] ..... C10M 1/50; C10M 3/44

[52] U.S. Cl. ..... 252/49.6; 252/52 R; 252/56 S

[58] Field of Search ..... 252/49.6, 52 R

[56] References Cited

U.S. PATENT DOCUMENTS

| | | | |
|---|---|---|---|
| 3,536,621 | 10/1970 | Christian | 252/49.6 |
| 3,679,585 | 7/1972 | Brook et al. | 252/51.5 A |
| 3,994,815 | 11/1976 | Coleman | 252/52 R |
| 4,190,546 | 2/1980 | Kulik et al. | 252/49.6 |

*Primary Examiner*—Ferris H. Lander
*Assistant Examiner*—C. Johnson
*Attorney, Agent, or Firm*—Frishauf, Holtz, Goodman & Woodward

[57] ABSTRACT

The present invention relates to a lubricant for use at high temperature, comprising: (A) from 25 to 98% by weight of an arylalkyl silicone having a repeating unit represented by the general formula (I); and (B) from 75 to 2% by weight of a fatty acid ester of a hindered alcohol. The lubricant of the invention is suitable for use as an engine oil. The general formula (I) follows:

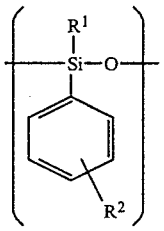

wherein $R^1$ is an alkyl group containing from 1 to 6 carbon atoms, and $R^2$ is an alkyl group containing from 1 to 3 carbon atoms or a hydrogen atom.

17 Claims, No Drawings

LUBRICANT FOR USE AT HIGH TEMPERATURE

BACKGROUND OF THE INVENTION

A silicone-based synthetic oil has heretofore been used as a lubricant for use at high temperature, and it has been verified that its evaporation loss at high temperatures is small. Conventional silicone-based synthetic oils, however, have disadvantages in that their load-carrying capacity is seriously low and they lack characteristics such as detergency which are required for the lubricant. In order to overcome the above-described problems and further to give other characteristics, it has been attempted to add various additives for lubrication, but with limited success since the additives are not soluble in the silicon-based synthetic oils. Hence they are not suitable for practical use.

For lubricants being used in an engine of the adiabatic type, a super high-temperature gas turbine bearing, an engine with a turbo charger, and so forth are required to withstand temperatures as high as 200° C. or more, although the upper temperature limit of the conventional lubricants for high-temperature use is 170°–180° C.

SUMMARY OF THE INVENTION

An object of the invention is to provide a lubricant which is free from the above-described disadvantages of silicon-based synthetic oil and can withstand high temperatures of 200° C. or more.

It has been found that the object can be attained by adding esters of hindered alcohols to a specific silicone-based synthetic oil.

The present invention relates to a lubricant for use at high temperature, comprising:

(A) from 25 to 98% by weight of an arylalkyl silicon having a repeating unit represented by the general formula (I):

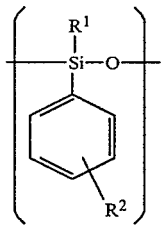

(wherein $R^1$ is an alkyl group containing from 1 to 6 carbon atoms, and $R^2$ is an alkyl group containing from 1 to 3 carbon atoms or a hydrogen atom), and having a kinematic viscosity as determined at 100° C. of from 5 to 300 centistokes; and (B) from 75 to 2% by weight of an ester of a hindered alcohol and a fatty acid.

DETAILED DESCRIPTION OF THE INVENTION

Component (A) of the lubricant of the invention is an arylalkyl silicone having a repeating unit represented by the general formula (I) as described above. In the general formula (I), $R^1$ represents an alkyl group containing from 1 to 6 carbon atoms, such as a methyl group, an ethyl group, a propyl group, and a butyl group, and $R^2$ represents a hydrogen atom or an alkyl group containing from 1 to 3 carbon atoms, such as a methyl group, an ethyl group, and a propyl group. $R^2$ may be linked to the aryl group of the general formula (I) at any or o-, m- and p-positions.

It is necessary for Component (A) to have a kinematic viscosity as determined at 100° C. of from 5 to 300 centistokes, preferably from 10 to 100 centistokes.

As Component (A), silicone not having the repeating unit of the general formula (I), and silicone having a kinematic viscosity out of the range as defined above even if it has the repeating unit of the general formula (I), is not preferable. Because a lubricant prepared by using the above-described silicone has disadvantages in that heat resistance is insufficient, lubricating performance is poor, and it has an insufficient ability to dissolve therein various additives for lubrication.

On the other hand, a lubricant containing the arylalkyl silicone as used herein, which has a repeating unit represented by the general formula (I) and a kinematic viscosity within the range as defined above, is free from the foregoing disadvantages.

Suitable examples of Component (A) include phenylmethyl silicone, methylphenylmethyl silicone, ethylphenylmethyl silicone, phenylethyl silicone, phenylpropyl silicone, phenylbutyl silicone, and propylphenylhexyl silicone.

Component (B) of the lubricant of the invention is, as described above, an ester of a hindered alcohol and a fatty acid. Various hindered alcohols can be used in the invention, including those compounds represented by the general formula (II):

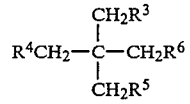

(wherein $R^3$ to $R^6$ are each a hydrogen atom, a hydroxyl group, a hydroxyl group-containing alkyl group, or an alkyl group, provided that at least one of $R^3$ to $R^6$ is a hydroxyl group or a hydroxyl group-containing alkyl group). Of the hindered alcohols represented by the general formula (II), those compounds in which the hydroxyl group-containing alkyl group and the alkyl group containing from 1 to 3 carbon atoms are preferred. Preferred examples of the hindered alcohols are polyhydric alcohols such as trimethylolpropane, trimethylolethane, pentaerythritol, neopentyl glycol, 2-methyl-2-propyl-1,3-propanediol, and the like. As well as the hindered alcohols of the general formula (II), compounds such as dipentaerythritol can be used.

The fatty acid as used herein is not critical; that is, any fatty acid can be used as long as it is capable of reacting with the above-described hindered alcohols to form the corresponding esters. Typical examples are fatty acids containing from 5 to 30 carbon atoms, such as saturated straight chain fatty acids (e.g., caprylic acid, capric acid, lauric acid, myristic acid, palmitic acid, stearic acid, arachic acid, and behenic acid), or the corresponding branched chain fatty acids or unsaturated fatty acids; dibasic acids (e.g., adipic acid, sebacic acid, and azelaic acid); and dimer acids, i.e., polymers of unsaturated fatty acids (e.g., oleic acid). Of these compounds, unsaturated fatty acids such as oleic acid and linolic acid, and branched chain fatty acids such as isostearic acid are preferred. These fatty acids may be used as their derivatives (e.g., acid halides). In brief, any fatty acids capable of forming esters on reacting with the hindered alcohols as described above can be used in the invention.

It is preferred for Component (B) to have a kinematic viscosity as determined at 100° C. of at least 5 centistokes, particularly from 8 to 50 centistokes.

The amount of Component (B) compounded should constitute from 2 to 75% by weight, preferably from 10 to 30% by weight of the total amount of Components (A) and (B). If the amount of Component (B) is less than 2% by weight, the effect of Compound (B) is exhibited insufficiently, whereas if it is more than 75% by weight, the stability against oxidation of the final lubricant undesiraly drops.

The lubricant of the invention basically comprises Components (A) and (B). If necessary, however, various additives such as amine-, phenol-, and dithiophosphoric acid-type antioxidants, sulfonate-, phenete-, phosphonate-, and salicylate-type detergent dispersants, sulfur/phosphorus-, and phosphate-type extreme pressure agents, and oiliness agents can be added.

Even if the lubricant of the invention is used at temperatures as high as 200° C. or more, particularly about 300° C., its evaporation loss is small and sludge is formed in lesser compounds. Furthermore the lubricant of the invention has a high ability to dissolve therein various additives, is of high storage stability, and is superior in load-carrying capacity.

Hence the lubricant of the invention is suitable for the lubricant of machine elements subjected to high temperatures of 200° C. or more, particularly in internal combusion engines; that is, is suitable for use as an engine oil.

The present invention is described in greater detail with reference to the following Examples and Comparative Examples.

EXAMPLES 1 TO 12, AND COMPARATIVE EXAMPLES 1 TO 6

Lubricants having the formulations described in the Table were prepared, and their physical properties were measured. The results are shown in the Table.

The following physical properties were tested.

Test of Thermal Stability:

A lubricant sample (30 grams) was placed in a beaker as specified in FIG. 153 of JIS K2839 and maintained at 320° C. for 3 hours. At the end of the time, the evaporation loss and the formation of sludge were determined.

Indiana stirring oxidation test: measured according to JIS K2514.

Falex friction test of Load-Carrying Capacity which includes lubricating a bearing (a rotating steel journal contacting opposed stationary V-blocks) with the lubricant being tested, and measuring load-carrying properties according to ASTM D3233.

TABLE

| | Example | | | | | | | | |
|---|---|---|---|---|---|---|---|---|---|
| | 1 | 2 | 3 | 4 | 5 | 6 | 7 | 8 | 9 |
| Lubricant-Constituting Components (parts by weight) | | | | | | | | | |
| Component (A) | | | | | | | | | |
| Phenylmethyl silicone*1 | 30 | 50 | 50 | 70 | 70 | 90 | 90 | 95 | |
| 4-Propylphenylhexyl silicone*2 | | | | | | | | | 70 |
| Dimethyl silicone*3 | | | | | | | | | |
| Component (B) | | | | | | | | | |
| Ester of trimethylolpropane and oleic acid*4 | 70 | 50 | | 30 | | 10 | | 5 | 30 |
| Composite ester of trimethylolpropane, adipic acid, and stearic acid*5 | | | 50 | | 30 | | 10 | | |
| Ester of pentaerythritol and oleic acid*6 | | | | | | | | | |
| Additives | | | | | | | | | |
| Phenothiazine | 1 | 1 | | 1 | 1 | | | 1 | |
| Phenyl-α-naphthylamine | | | 1 | | | | 1 | | |
| Calcium sulfonate (TBN = 25) | 3 | 3 | | | | 5 | | | |
| Calcium phenate (TBN = 150) | | | 5 | | 5 | 5 | | | |
| Barium phosphonate (TBN = 170) | 5 | 5 | 5 | 5 | 5 | | | | |
| Tricresyl phosphate | | | | | | | 1 | | |
| Physical Properties | | | | | | | | | |
| Test of Thermal Stability | | | | | | | | | |
| Evaporation loss (% by weight) | 15 | 14 | 19 | 14 | 15 | 13 | 12 | 9 | 12 |
| Formation of sludge | None | None | None | None | None | None | None | None | None |
| Indiana stirring oxidation test | | | | | | | | | |
| Increase in viscosity (viscosity ratio) as determined at 40° C. | 3.0 | 1.3 | 1.8 | 1.7 | 1.7 | 1.6 | 1.8 | 1.8 | 1.8 |
| Total acid value | 3.9 | 0.8 | 0.9 | 1.0 | 1.5 | 1.5 | 0.2 | 0.2 | 1.5 |
| Falex friction test of Load-Carrying Capacity (LBS) | 900 | 700 | 700 | 700 | 700 | 700 | 600 | 600 | 700 |
| Appearance | Good | Good | Good | Good | Good | Good | Good | Good | Good |

| | Example | | | Comparative Example | | | | | |
|---|---|---|---|---|---|---|---|---|---|
| | 10 | 11 | 12 | 1 | 2 | 3 | 4 | 5 | 6 |
| Lubricant-Constituting Components (parts by weight) | | | | | | | | | 100 |
| Component (A) | | | | | | | | | |
| Phenylmethyl silicone*1 | | 70 | | 100 | 100 | | 20 | | |
| 4-Propylphenylhexyl silicone*2 | 90 | | 70 | | | | | | |
| Dimethyl silicone*3 | | | | | | 70 | | | (Paraffinic Mineral Oil*7) |
| Component (B) | | | | | | | | | |
| Ester of trimethylolpropane and oleic acid*4 | | | | | | 30 | 80 | | |
| Composite ester of trimethyolpropane, | | | 30 | | | | | | |

TABLE-continued

| | | | | | | | | | |
|---|---|---|---|---|---|---|---|---|---|
| adipic acid, and stearic acid*5 | | | | | | | | | |
| Ester of pentaerythritol and oleic acid*6 | 10 | 30 | | | | | | 100 | |
| Additives | | | | | | | | | |
| Phenothiazine | | | | | 1 | 1 | 1 | | |
| Phenyl-α-naphthylamine | | | | | | | | | |
| Calcium sulfonate (TBN = 25) | | | | | 5 | | 3 | | |
| Calcium phenate (TBN = 150) | | | | | | | | | |
| Barium phosphonate (TBN = 170) | | | | | | | 5 | | |
| Tricresyl phosphate | | | | | | | | | |
| Physical Properties | | | | | | | | | |
| Test of Thermal Stability | | | | | | | | | |
| Evaporation loss (% by weight) | 10 | 13 | 14 | 8 | —*8 | —*8 | 16 | 17 | 70 |
| Formation of sludge | None | None | None | None | —*8 | —*8 | None | None | Formed |
| Indiana stirring oxidation test | | | | | | | | | |
| Increase in viscosity (viscosity ratio) as determined at 40° C. | 1.9 | 1.8 | 1.9 | 1.1 | —*8 | —*8 | 3.3 | 3.6 | 4.5 |
| Total acid value | 0.5 | 1.5 | 1.4 | 0.2 | —*8 | —*8 | 6.7 | 11.0 | 13.0 |
| Falex friction test of Load-Carrying Capacity (LBS) | 600 | 700 | 700 | 300 | —*8 | —*8 | 1000 | 1100 | 1000 |
| Appearance | Good | Good | Good | Good | —*8 | —*8 | Good | Good | Good |

Note:
*1Silicone SH 500 (30 centistokes) (produced by Toray Co., Ltd.)
*2Silicone SH 203 (150 centistokes) (produced by Toray Co., Ltd.)
*3Silicone SH 200 (20 centistokes) (produced by Toray Co., Ltd.)
*4Unister H-381R (produced by Nippon Oils & Fats Co., Ltd.)
*5Unister C-3373H (produced by Nippon Oils & Fats Co., Ltd.)
*6Unister H-481R (produced by Nippon Oils & Fats Co., Ltd.)
*7Viscosity: 30 centistokes (100° C.)
*8Impossible to measure because of insolubility and separation.

What is claimed is:

1. A lubricating oil for lubricating bearing useful at high temperatures of 200° C. or higher, comprising:

(A) from 25 to 98% by weight of an arylalkyl silicone having a repeating unit represented by the general formula (I):

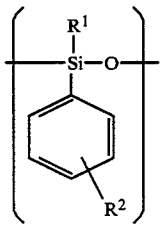

wherein $R^1$ is an alkyl group containing from 1 to 6 carbon atoms, and $R^2$ is an alkyl group containing from 1 to 3 carbon atoms or a hydrogen atom, and having a kinematic viscosity as determined at 100° C. of from 5 to 300 centistokes; and (B) from 75 to 2% by weight of a fatty acid ester of a hindered alcohol.

2. The lubricating oil of claim 1, wherein the lubricating oil is an engine oil.

3. The lubricating oil of claim 1, wherein the arylalkyl silicone has a kinematic viscosity as determined at 100° C. of from 10 to 100 centistokes.

4. The lubricating oil of claim 1, wherein the arylalkyl silicone is a compound selected from the group consisting of phenylmethyl silicone, methylphenylmethyl silicone, ethylphenylmethyl silicone, phenylethyl silicone, phenylpropyl silicone, phenylbutyl silicone and propylphenylhexyl silicone.

5. The lubricating oil of claim 1, wherein the hindered alcohol is one of the compounds represented by the general formula (II):

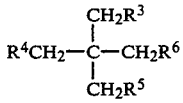

wherein $R^3$ to $R^6$ are each a hydrogen atom, a hydroxyl group, a hydroxyl group-containing alkyl group, or an alkyl group, provided that at least one of $R^3$ to $R^6$ is a hydroxyl group or a hydroxyl group-containing alkyl group.

6. The lubricating oil of claim 5, wherein the compounds represented by the general formula (II) are trimethylolethane, trimethylolpropane, pentaerythritol, neopentyl glycol and 2-methyl-2-propyl-1,3-propanediol.

7. The lubricating oil of claim 1, wherein the fatty acid is at least one compound selected from the group consisting of fatty acids containing from 5 to 30 carbon atoms, dibasic acids and dimer acids.

8. The lubricating oil of claim 1, wherein the fatty acid ester of a hindered alcohol has a kinematic viscosity as determined at 100° C. of at least 5 centistokes.

9. The lubricating oil of claim 1, wherein the amount of Component (B) is from 10 to 30% by weight of the total amount of Components (A) and (B).

10. The lubricating oil of claim 3, wherein the hindered alcohol is one of the compounds represented by the general formula (II):

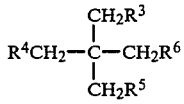

wherein $R^3$ to $R^6$ are each a hydrogen atom, a hydroxyl group, a hydroxyl group-containing alkyl group, or an alkyl group, provided that at least one of $R^3$ to $R^6$ is a hydroxyl group or a hydroxyl group-containing alkyl group and wherein the fatty acid ester of a hindered alcohol has a kinematic viscosity as determined at 100° C. of at least 5 centistokes.

11. The lubricating oil of claim 10, wherein the arylalkyl silicone is a compound selected from the group consisting of phenylmethyl silicone, methylphenylmethyl silicone, ethylphenylmethyl silicone, phenylethyl silicone, phenylpropyl silicone, phenylbutyl silicone and propylphenylhexyl silicone.

12. The lubricating oil of claim 11, wherein the compounds represented by the general formula (II) are trimethylolethane, trimethylolpropane, pentaerythritol, neopentyl glycol and 2-methyl-2-propyl-1,3-propanediol and wherein the fatty acid is at least one compound selected from the group consisting of fatty acids containing from 5 to 30 carbon atoms, diabasic acids and dimer acids.

13. The lubricating oil of claim 12, wherein the amount of Component (B) is from 10 to 30% by weight of the total amount of Components (A) and (B).

14. The lubricating oil of claim 3, wherein the hindered alcohol is one of the compounds represented by the general formula (II):

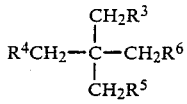

wherein $R^3$ to $R^6$ are each a hydrogen atom, a hydroxyl group, a hydroxyl group-containing alkyl group, or an alkyl group, provided that at least one of $R^3$ to $R^6$ is a hydroxyl group or a hydroxyl group-containing alkyl group and wherein the amount of Component (B) is from 10 to 30% by weight of the total amount of Components (A) and (B).

15. The lubricating oil of claim 14, wherein the arylalkyl silicone is a compound selected from the group consisting of phenylmethyl silicone, methylphenylmethyl silicone, ethylphenylmethyl silicone, phenylethyl silicone, phenylpropyl silicone, phenylbutyl silicone and propylphenylhexyl silicone.

16. The lubricating oil of claim 15, wherein the compounds represented by the general formula (II) are trimethylolethane, trimethylolpropane, pentaerythritol, neopentyl glycol and 2-methyl-2-propyl-1,3-propanediol and wherein the fatty acid is at least one compound selected from the group consisting of fatty acids containing from 5 to 30 carbon atoms, dibasic acids and dimer acids.

17. The lubricating oil of claim 16, wherein the fatty acid ester of a hindered alcohol has a kinematic viscosity as determined at 100° C. of at least 5 centistokes.

* * * * *